US006805429B2

(12) United States Patent
Khalid

(10) Patent No.: US 6,805,429 B2
(45) Date of Patent: Oct. 19, 2004

(54) APPARATUS FOR ALIGNMENT OF MULTIPLE PAGE-WIDE ARRAY PRINT HEADS

(75) Inventor: Najeeb Khalid, Westmound (CA)

(73) Assignee: Escher-Grad Technologies, Inc., Lachine (CA)

( * ) Notice: Subject to any disclaimer, the term of this patent is extended or adjusted under 35 U.S.C. 154(b) by 61 days.

(21) Appl. No.: 10/366,514

(22) Filed: Feb. 14, 2003

(65) Prior Publication Data

US 2004/0160476 A1 Aug. 19, 2004

(51) Int. Cl.[7] ..... B41J 2/155
(52) U.S. Cl. ..... 347/42; 347/13
(58) Field of Search ..... 347/42, 13, 49, 347/108

(56) References Cited

U.S. PATENT DOCUMENTS

| | | | | |
|---|---|---|---|---|
| 6,142,622 A | | 11/2000 | Blanchard, Jr. et al. | 347/104 |
| 6,315,390 B1 | | 11/2001 | Fujii et al. | 347/42 |
| 6,318,835 B2 | | 11/2001 | Nakahara | 347/30 |
| 6,679,584 B2 | * | 1/2004 | Silverbrook | 347/42 |

* cited by examiner

*Primary Examiner*—Lamson D Nguyen
(74) *Attorney, Agent, or Firm*—Ogilvy Renault

(57) ABSTRACT

An apparatus adapted to house page-wide arrays (PWAs) of print heads in a printing apparatus comprises a plurality of support structures each housing a PWA. Each PWA comprises a linear array of print nozzles in a lateral direction. The structures are stacked in a vertical array and are each attached to a wall structure at a closed lateral end of the structure. Opposite the closed end, each structure has an open end for lateral insertion and removal of the corresponding PWA. Between the open and closed ends, each structure has an opening in a front face through which the array of nozzles in the corresponding PWA may operate while housed in the structure. An adjustable protrusion extends within each structure from the closed end, whereby the lateral position of the corresponding PWA may be fixed relative to the closed end of the structure and the wall structure. A locking mechanism at the open end of the structure may be engaged to secure the PWA within each structure against the corresponding protrusion and prevented from moving in a lateral direction. When the locking mechanism is disengaged, the PWA may be removed or inserted through the open end of the structure. The lateral pressures applied by the locking mechanism and the protrusion in each structure fixes the lateral position of each PWA relative to each other and with respect to the wall structure.

16 Claims, 7 Drawing Sheets

APPARATUS FOR ALIGNMENT OF MULTIPLE PAGE-WIDE ARRAY PRINT HEADS

CROSS-REFERENCE TO RELATED APPLICATIONS

This is the first application filed for the present invention.

MICROFICHE APPENDIX

Not applicable.

TECHNICAL FIELD

The invention relates to modular page-wide array (PWA) print heads, and, in particular, to a method and apparatus for precision-mounting and removing page-wide array print heads by unskilled technicians.

BACKGROUND OF THE INVENTION

Recent developments in ink-jet printing technology have led to the realization of page-wide arrays (PWAs) of ink-jet print heads all oriented in the same direction in a linear array. Each print head is composed of a linear array of evenly-spaced ink-jet nozzles. The print heads in a PWA extend in the direction defined by the width of the print head (horizontally, for the purposes of discussion) across the entire width of the allowable printing area. Thus, the PWA does not need to move horizontally relative to the printing material, in order to provide print coverage across the width of the printing area. Rather the material to be printed is typically mounted on a web which passes vertically past the PWA. This permits printing at speeds heretofore impossible to achieve with ordinary ink-jet printers.

Additionally, multiple PWAs are organized in a vertical array, in which each PWA is offset by a fraction of the horizontal separation between adjacent nozzles within a print head. Thus, the cumulative effect of the vertical array of PWAs permit a print resolution in the horizontal direction which is a multiple of the print resolution of the print head in isolation. The print resolution in the vertical direction is defined by the speed at which the web passes relative to the vertical array of PWAs, together with the space between the nozzles of the PWA array and the web itself.

In addition to providing a greater horizontal print resolution, arrangements of multiple PWAs may be positioned in close proximity to produce a compact printing apparatus. The nature of the constituent PWAs define the function of the resulting apparatus, such as providing 4- or higher colour separation or ultra-high resolution monochrome printing.

While PWAs provide significant advantages in the printing art, the large number of print heads causes concomitant maintenance problems. Ink-jet cartridges, by their nature, require frequent, regular and relatively complex service. The large number and close proximity of the print heads within PWAs and the close proximity of PWAs within a printing apparatus, as well as the typically tight spacing between print head nozzles and the web exacerbates the problem. Typically, print heads are required to be removed in order to be serviced and or replaced. The nature of the PWA requires that the component print heads be precisely aligned within a PWA and with respect to other PWAs. While PWAs may be inserted and removed as a single replaceable unit, the installation and removal of PWAs has nevertheless typically required the use of highly skilled technicians and the process of removal and installation has been time-intensive, leading to considerable expense in the form of labour costs and down time of the printing apparatus.

What is therefore required is an apparatus for supporting multiple PWAs in a printing apparatus, so that the PWAs can be quickly removed and replaced by non-skilled technicians, while maintaining the precise alignment between PWAs in the printing apparatus.

SUMMARY OF THE INVENTION

Therefore an object of the invention is to provide a structure for maintaining a PWA in a precise orientation within a printing apparatus that permits rapid insertion and removal of the PWA by non-skilled personnel.

In accordance with the present invention, there is provided a bay for supporting a page-wide array (PWA) of print heads. The bay may be configured in a vertical array to permit multiple PWAs to be simultaneously supported in a printing apparatus. The bay includes a support structure having supporting surfaces for maintaining the proper vertical orientation of the PWA as it is inserted into, maintained within and removed from the bay. The spacing between the supporting surfaces of the bay is such that the PWA is sufficiently constrained from vertical movement, without unduly inhibiting the insertion and removal of the PWA. The supporting surfaces do not obstruct the nozzles of the PWA print head from projecting ink horizontally from a vertical face of the PWA.

The bay is fixed with reference to a wall structure and an adjustable protrusion permits horizontal precise positioning of the PWA within the bay with respect to the wall, which together provide for alignment of the PWA print head within the bay. The protrusion consists of a bolt having an exterior thread that engages an internal threaded bore in the wall to permit adjustment in the horizontal direction. The pitch of the exterior thread is sufficiently fine to permit precision alignment of the PWA relative to the wall. An internal bore in the bolt permits rotation of the bolt to the desired depth using an Allen key. The protrusion is locked into place relative to the wall by a nut that engages the exterior thread of the bolt within the bay.

The bay also provides a convenient locking mechanism disposed at an opening at an end distal from the wall. The PWA is inserted and removed through the opening when the locking mechanism is in an open position. The locking mechanism may be moved into a closed position where it applies a persistent force on a PWA situated in the bay, to urge the PWA print head into contact with the print head locater. Where the printing apparatus features a vertical array of bays, the locking mechanism of each bay is linked, so that the bays may be opened or closed by a single operation.

Also according to the objects of the invention, a printing apparatus with multiple page-wide array (PWA) print heads is provided. The printing apparatus includes a system for feeding a print medium at a predetermined rate across a printing area to a print output, a plurality of PWA print heads for imparting ink onto the print medium in accordance with a bit map received by a signal processing means of the printing apparatus, and a bay as described above for each of the PWAs.

A method for replacing a page-wide array (PWA) in a printing apparatus is also provided in accordance with an aspect of the invention. The method involves opening a locking mechanism that obstructs the opening to the bay that encloses the PWA; removing the PWA from the bay through the opening; inserting a replacement PWA print head into the bay through the opening; and closing the locking mechanism so that the locking mechanism urges the PWA print head into contact with a print head locater in a fixed position with reference to a wall to which the bay is attached, wherein the supporting structure of the bay constrains the vertical positioning of the PWA and the locking mechanism and the protrusion constrain the horizontal positioning of the PWA.

BRIEF DESCRIPTION OF THE DRAWINGS

Further features and advantages of the present invention will become apparent from the following detailed description, taken in combination with the appended drawings, in which.

It should be noted that throughout the appended drawings, like features are identified by like reference numerals.

DETAILED DESCRIPTION OF THE PREFERRED EMBODIMENT

The invention provides a method and apparatus for precisely aligning PWA print heads that may be removed and inserted by non-skilled personnel.

In a PWA printing apparatus, a print medium is typically transported between the PWAs an d a fixed print area at a predetermined rate. The print area is equidistant to all nozzles of the PWA.

Those having ordinary skill in this art will recognize that small differences in the angle ($\alpha$) that the nozzles expel ink from an axis normal to the plane of the printing surface may be accommodated having regard to the small nominal distance (d) from the nozzle to the medium to be printed. The disparity in actual distance ($d_{act}$) is represented by the relation $$d_{act}=d \sin(\alpha)$$

Thus, if the nominal distance d is $1/32^{nd}$ of an inch and the permitted disparity $d_{act}$ is 1/3 of the inter-nozzle separation (for example, $1/360^{th}$ of an inch), the permitted angular tolerance $\alpha$ will be about 1.7°.

Figure 1:
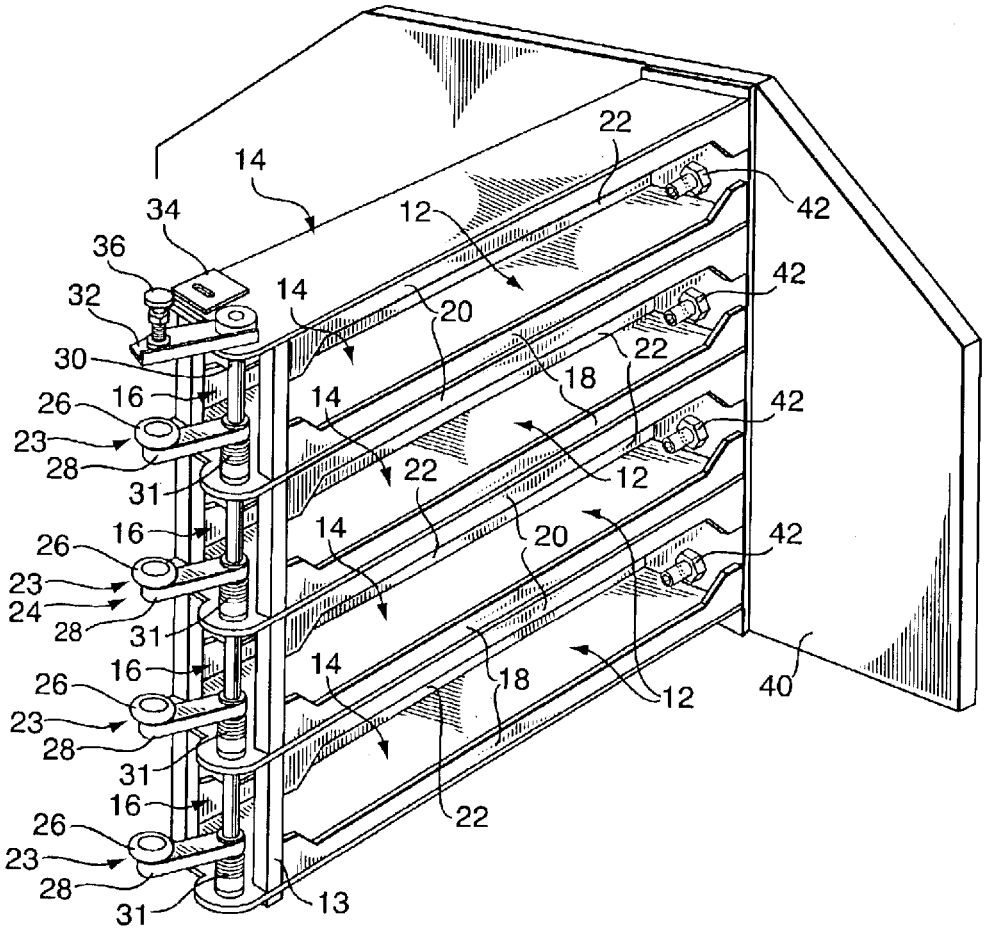
FIG. 1 schematically illustrates a complement of four bays in accordance with an embodiment of the present invention.

FIG. 1 shows an exemplary printing apparatus 10 that includes four bays 12, each adapted to hold a PWA in a vertical arrangement and having a common orientation. Each PWA contains a plurality of print heads in a horizontal array as a single replaceable unit. Those having ordinary skill in the art will recognize that printing configurations do not necessarily require or permit strictly vertical orientation of the printing area. The use of directional terminology in this description therefore, is merely exemplary and for convenience of explanation and should not be understood to limit the invention to embodiments having such an orientation.

The external portion of the PWA is composed of a rigid material that will maintain is precise shape despite the application of pressure from without.

As is well known in the art, four print heads are used in most color printers and presses, each of the four print heads supplying a respective one of the following colors of ink: cyan, magenta, yellow, and black. The alignment of PWA print heads in a color printing apparatus may depend upon color mixing and the amount of overlap between adjacent lines on the printing apparatus, as well as other factors, such as the print medium used, the operating temperature, the wetness of the ink when applied to the print medium, and the size and viscosity of ink droplets. In some cases, therefore, PWAs in a multi-colour printing apparatus must be aligned in a precision greater than that of the inter-nozzle distance of the PWA print head.

Those having ordinary skill in this art will readily recognize that a greater or lesser number of PWAs may be placed in vertical arrangement. For example, greater than 4-colour separation may be required. Further, the horizontal print resolution in either colour or monochrome print applications may require enhancement by using multiple PWAs each horizontally offset from the other. In order to ensure printing accuracy, each PWA must be offset by the same amount, namely the quotient obtained by dividing the inter-nozzle spacing in the print heads by the number of offset PWAs in the vertical array. The horizontal print resolution will thus be the product of the horizontal print resolution of the PWA and the number of offset PWAs in the array.

Each bay 12 is defined by a support structure that consists of vertical supports 13 and horizontal panels 14 that form the floor and ceiling of the bay 12. The horizontal panels 14 are composed of a strong, smooth material that permits low friction insertion and removal fo the PWA, for example, stainless steel. Where multiple bays 12 are arranged in a vertical array, intermediate horizontal panels 14 may act as both the floor of an upper bay 12 and the ceiling of the immediately lower bay 12. The horizontal panels 14 are approximately the shape of the PWAs to be housed within the bay 12 but slightly larger, so that the PWAs may be situated entirely or almost entirely within the bay 12. The spacing between horizontal panels 14 is such that the PWA is sufficiently constrained vertically within the bay 12. Taking the exemplary values for d and $d_{act}$ set out above, in order to ensure that the permitted angular tolerance a remains less than 1.7°, experiments have shown that, depending upon the size of the PWA, a vertical disparity of up to an inch may be tolerated.

One of the sides of the bay 12 (the front face) corresponds to the side of the PWA from which the nozzles protrude. A printing area (not shown) extends roughly parallel to the respective front faces of the bays 12 in the vertical array. Along the front face, a floor lip 18 partially extends upwardly from the floor of the bay 12 and a ceiling lip 20 partially extends downwardly from the ceiling of the bay 12, The profile of the floor lip 18 and the ceiling lip 20 is such that the flow of ink to the printing area from the nozzles in a PWA housed within the bay 12 will not be impeded, while preventing the PWA from falling out the front face of the bay 12.

The side of the bay 12 opposite to the front face (the back face) may also feature a floor lip and a ceiling lip (not shown) to prevent the PWA from falling out the back face of the bay 12. The profile of such floor and ceiling lips will be such as to permit access to the back of the PWA as is required for purposes of signal connection and the like as is common in the art. Frequently, once the PWA has been inserted into the bay 12, as discussed below, a pressure plate (not shown) is also inserted, which forces the PWA forward toward the front face of the bay 12. In such case, the pressure plate may have openings that correspond to connectors that may need to be attached to the back of the PWA, and the floor and ceiling lips need only have sufficient profile to guide the insertion of the pressure plate.

One side(the wall end) of the bay 12 adjacent to the front face is closed and is attached to a wall structure 40. The wall structure 40 is fabricated of a resilient substance that is not deformed by stresses applied to it under normal operating conditions. Accordingly, the wall structure 40 may be considered to define a rigid plan from which the horizontal position of the PWAs mounted within the bays 12 may be defined. The wall structure 40 need not be strictly planar, so long as it provides a reliable reference point for the horizontal position of each PWA.

Figure 2:
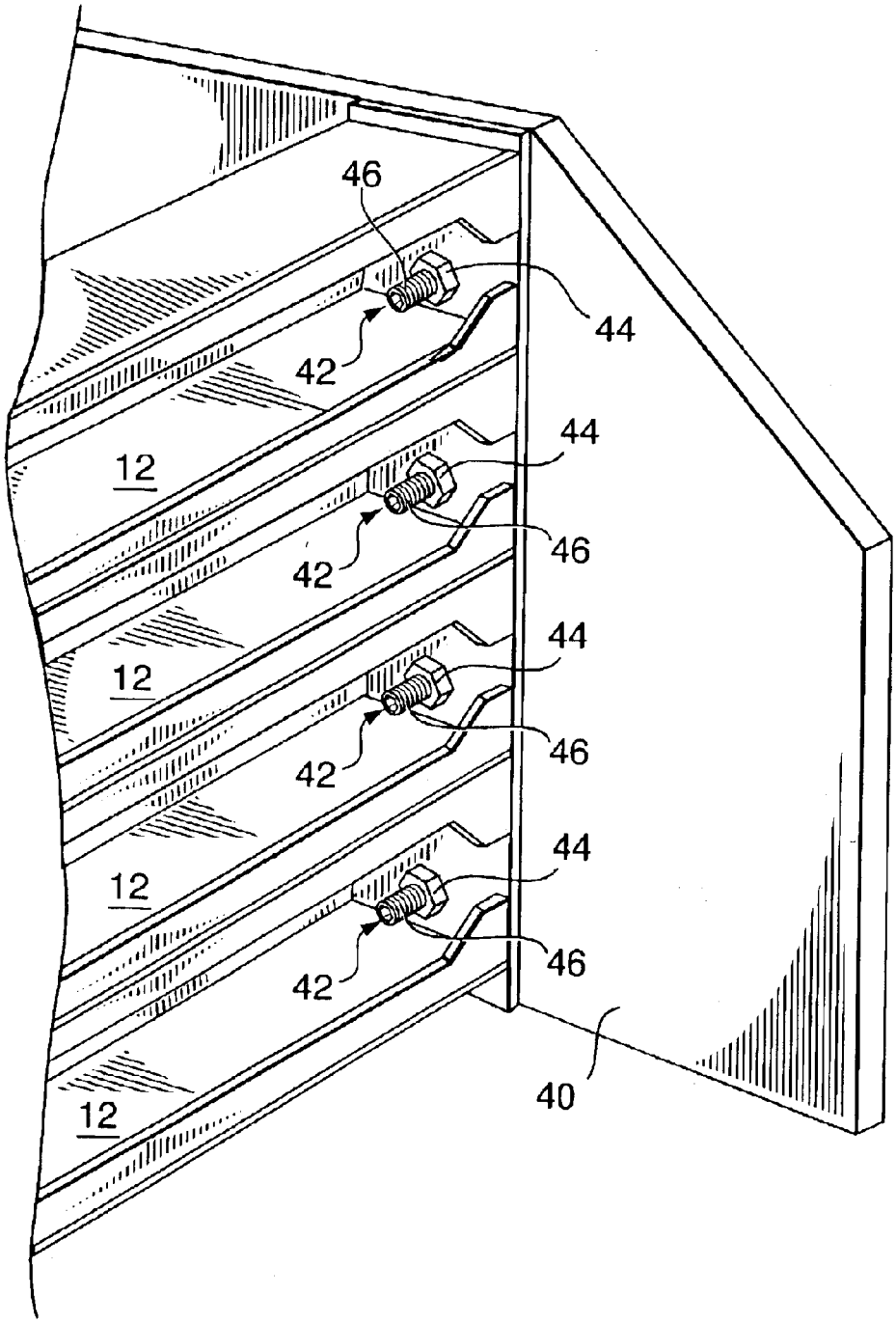
FIG. 2 schematically illustrates an enlarged view of a back end of the four bays illustrated in FIG. 1.
Figure 3:
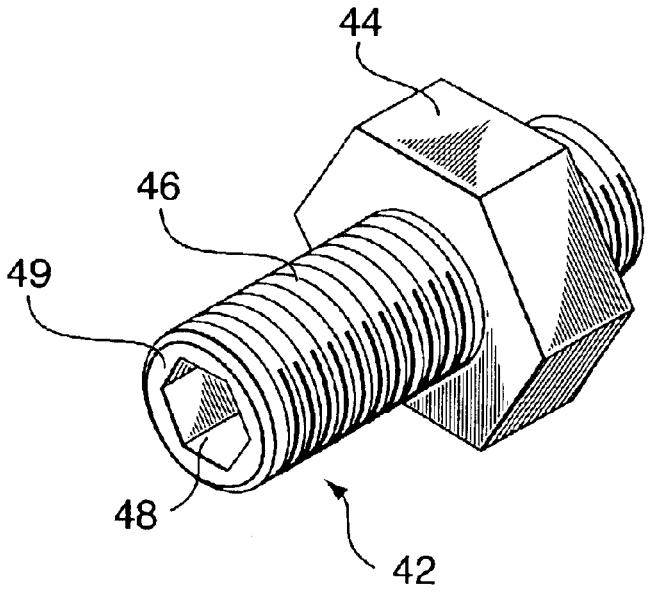
FIG. 3 schematically illustrates an embodiment of a print head locater in accordance with the present invention.

The wall end of the bay 12 may be independently fastened to the wall structure 40 by fasteners known in the art. Alternatively, the wall end of the bay 12 may be fastened to the wall structure 40 directly by a protrusion 42. As is more closely shown in FIGS. 2 and 3, the protrusion 42 consists of a bolt 46 having an exterior thread and an correspondingly internally threaded nut 44. The bolt 46 passes through an opening in the wall end of the bay 12 and engages a internally threaded bore (not shown) in the wall structure 40. When the protrusion 42 is used to fasten the wall end of the bay 12 to the wall structure 40, a second nut (not shown) or similar fastening means may be used on the other side of the wall structure 40.

The pitch of the exterior thread on the bolt 46 is sufficiently fine to permit precise adjustment of the extent that the top 49 of the bolt 46 extends into the bay 12 from the wall end. In order to permit the bolt 46 to be threaded into the wall structure 40 without destroying the external thread pattern on the bolt, a polygonal internal bore extends axially through the bolt 46 from its top 49, whereby an Allen key or other suitable device may be inserted so as to permit rotation of the bolt 46 and into the bore in the wall structure 40 to the desired depth. Once the bolt 46 has been positioned so that the top 49 extends into the bay 12 from the wall end to the desired extent, the position of the bolt 46 may be fixed by applying and tightening the nut 44 about the bolt and abutting the wall end of the bay 12, so as to preclude any further movement of the bolt 46.

While a plurality of protrusions 42 may be used within a bay, especially if the protrusions 42 are used to fasten the bay 12 to the wall structure 40, preferably only one protrusion 42 per bay 12 is used for PWA alignment purposes, so as to considerably simplify the alignment process. If other protrusions 42 are used, these may be adjusted to protrude into the bay 12 a lesser distance than the protrusion 42 used for alignment. Preferably, the protrusion 42 used for alignment is aligned with the center of mass of the PWA so as not to apply any shearing force to the PWA when the bay 12 is locked, as discussed below.

Figure 4:
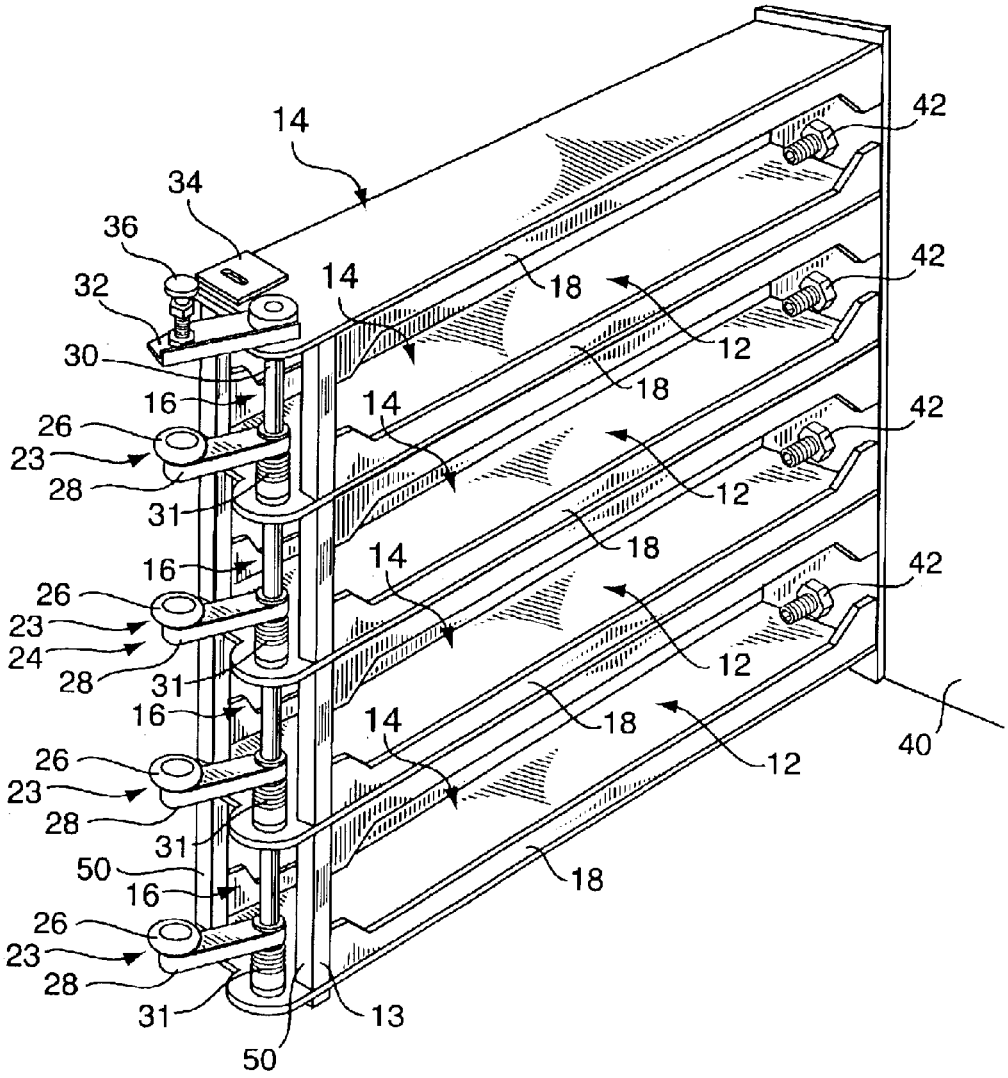
FIG. 4 schematically illustrates an enlarged view of a front end of the four bays illustrated in FIG. 1.
Figure 5:
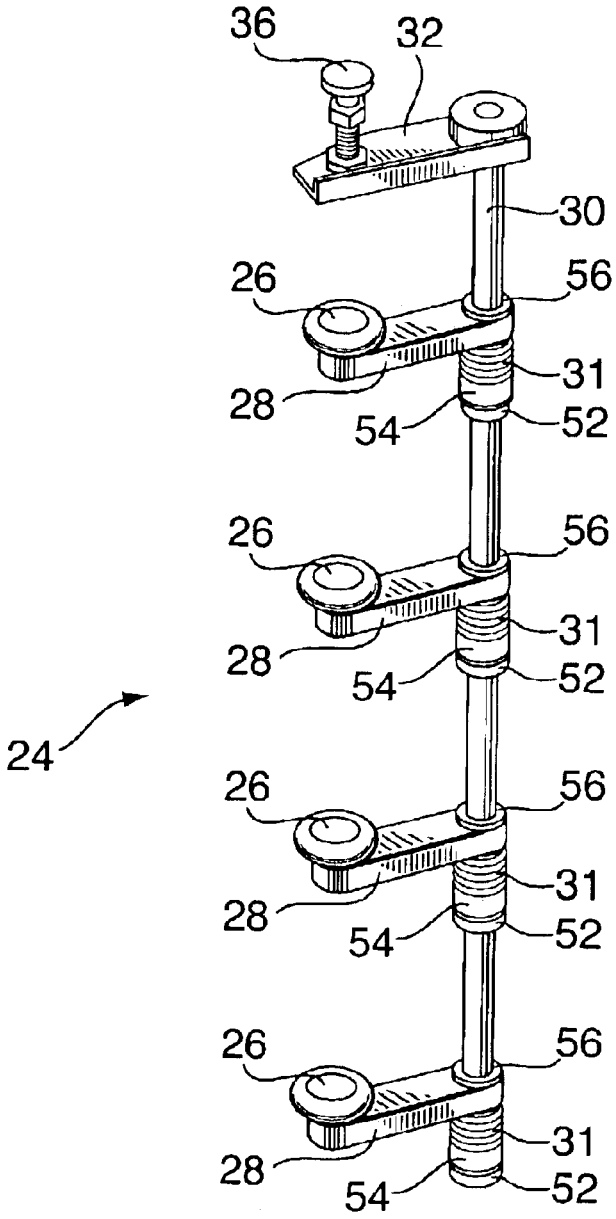
FIG. 5 schematically illustrate s an embodiment of a locking mechanism in accordance with the present invention.

The side of the bay 12 opposite the wall end (the insertion end)is shown in FIG. 4. The opening in the insertion end is defined by a pair of the vertical supports 13 and a pair of the horizontal plates 14. The vertical supports 13 in corresponding bays 12 form a rigid vertical pillar 50 that extends across the entire height of the vertical array of bays 12. The horizontal plates 14 extend slightly beyond one of the pillars 50 (in FIG. 4, the pillar 50 proximate to the front face of the bay 12), and have a circular bore hole (not shown) therewithin, through which an axial rod 30 may be inserted, as may be better seen in FIG. 5.

The axial rod 30 is seated within each bore hole by a seating ring 52 which snugly fits within the bore hole and through which the axial rod 30 may pass and be supported vertically, without being substantially impeded from about its axis. A footing 54 is attached to the axial rod 30 above each horizontal plate 52 and snugly engage the seating rings 52. The axial rod 30 is not free to rotate with respect to the footings 54. Each footing 54 is adapted to engage a bottom end of a spring 31 that surrounds the axial rod 30 above the footing 54. The top end of the spring 31 is attached to a horizontal swing arm 28 that has a bore (not shown), through which the axial rod 30 may pass by way of an intermediate collar 56. The collar 56 supports the swing arm 28, which is free to rotate horizontally about the axial rod 30.

The attachment of the top end of the spring 31 to the swing arm 28, however, biases the swing arm 28 in a rotational direction away from the insertion end of the bay 12(in the figures, in a counterclockwise direction when viewed from above). Thus, the axial rod 30, the swing arms 28, the springs 31, the seating rings 52, the footings 54 and the collars 56 all cooperate to provide a hinged locking mechanism 24 that is biased in the normally open position.

The far end of each swing arm 28 terminates in a contact pad 26 that is adapted to come into contact with an exposed end of the PWA when inserted into the bay 12. The height of the springs 31 and the length of the swing arms 28 are such that the contact pad 26 will come into contact with the PWA at approximately its center of mass and approximately opposite to the corresponding protrusion 42 in the bay 12.

A lever arm 32 is fixed to the top of the axial rod 30 and terminates in a knob 36 that is adapted to engage a clasp 34 attached to the uppermost bay 12 near its insertion end and proximate to the back face. The lever arm 32 is not free to rotate with respect to the axial rod 30, so that when the knob 36 of the lever arm 32 engages the clasp 34, the locking mechanism 24 may be engaged to close the insertion end of the bay 12 and apply lateral pressure on such PWAs as may be inserted into the bays 12 of the vertical array by the contact pads 26 on each swing arm 28.

Because the pressure applied by the contact pad 26 on a PWA, when the locking mechanism 24 is engaged, is approximately opposite to the simultaneous and equal pressure applied by the protrusion 42 at the wall end, no shearing forces will be applied to the PWA. Additionally, the fine adjustment of the protrusion 42 and the rigid structure of the PWA ensures that the nozzles of the PWA, when inserted and locked, will be precisely aligned as required to provide a satisfactory printing result.

The process of inserting and removing a PWA from the bays 12 is easily accomplished by even unskilled technicians. To remove a PWA, the technician simply releases the knob 36 from the clasp 34. The locking mechanism 24, being biased in the open position, will spring open, exposing one end of the PWAs housed in the bays 12. Additionally, the release of lateral pressure by the contact pads 26 on the PWAs, may cause the PWAs to extend slightly beyond the insertion end of the bay 12 and permit the PWA to be easily grasped. In any event, the PWA may be easily removed from the bay 12 through the insertion end, although, if a pressure plate has been inserted to urge the PWA forward toward the front face of the bay, such pressure plate will need to be removed first, again through the open insertion end of the bay 12.

To insert the same or a replacement PWA, the technician need simply slide the PWA, properly oriented, into the appropriate bay 12 through the open insertion end. If a pressure plate is to be used, the pressure plate is slid into the bay 12 through the open insertion end, between the PWA and the back face of the bay 12. When all PWAs (and pressure plates) have been inserted, the technician simply pushes the lever arm 32 toward the clasp 34 and engages the clasp 34 with the knob 36 to close the insertion end of each bay 12.

Figure 6:
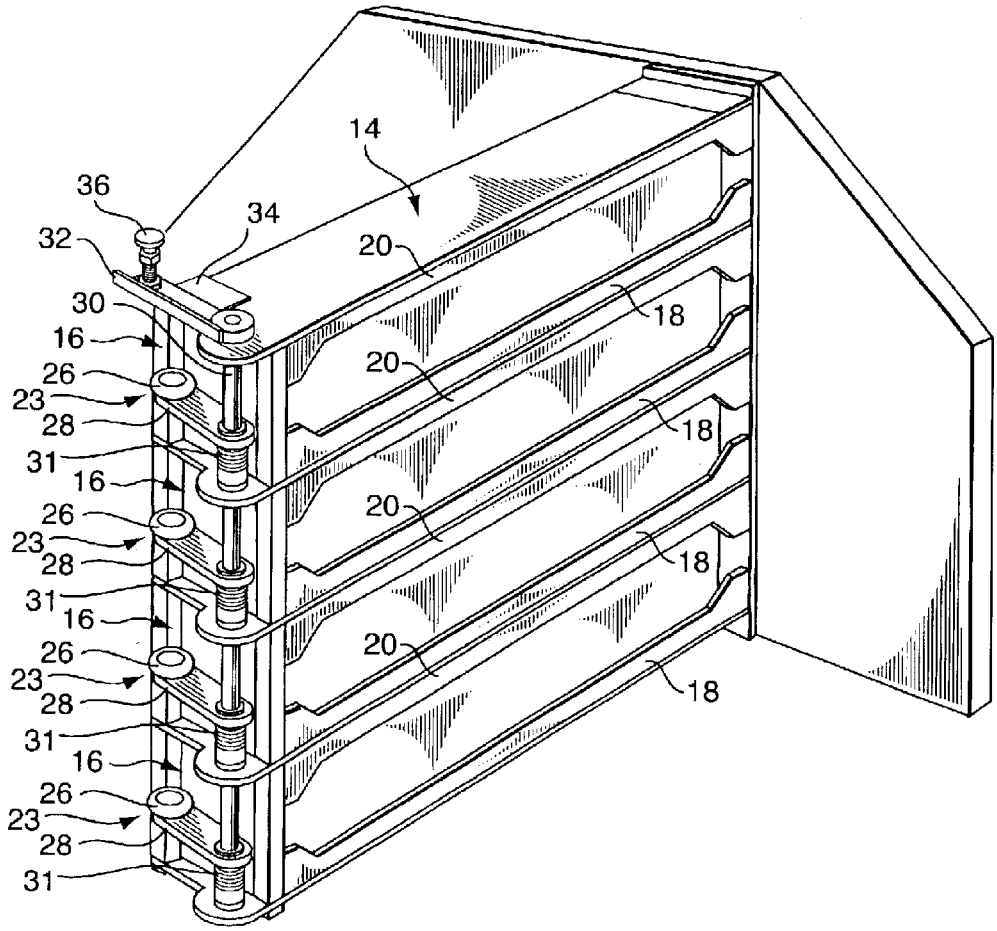
FIG. 6 schematically illustrates the four bays containing respective PWA print heads.
Figure 7:
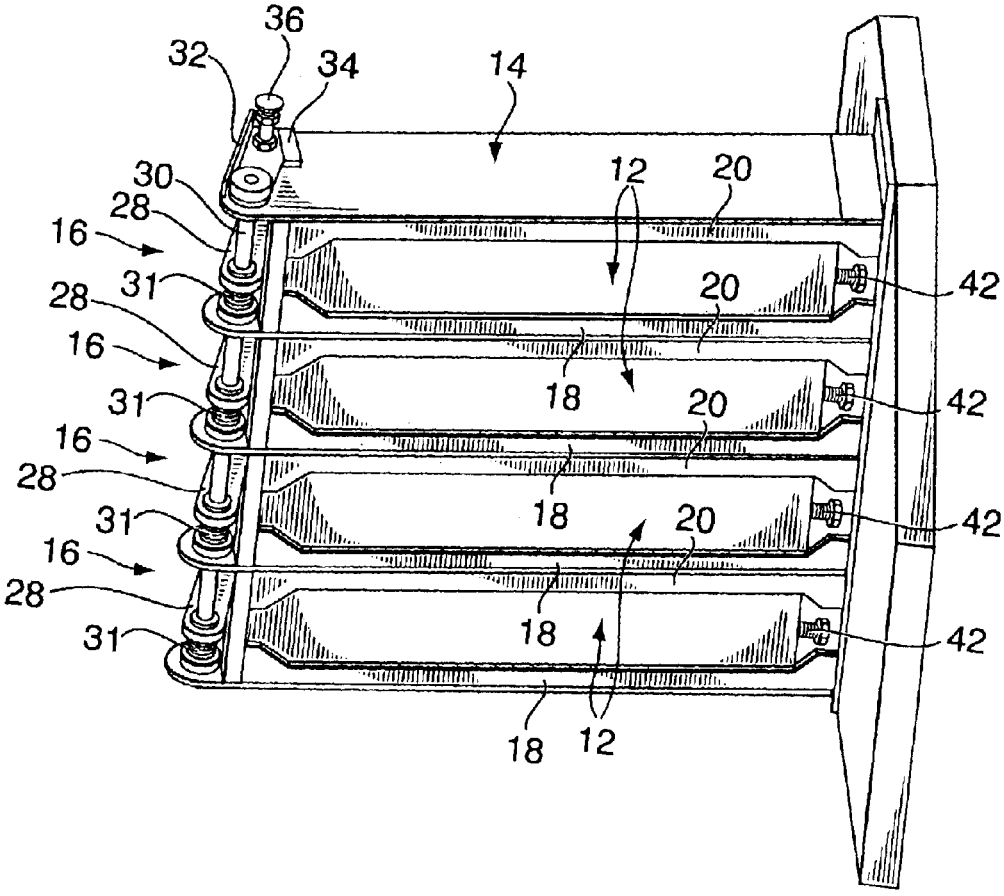
FIG. 7 schematically illustrates an alternate view of FIG. 6 wherein both ends are in view.

FIGS. 6 and 7 illustrate the four bays containing respective PWA print heads, which are held in position by closure of the locking mechanism 24. Many other embodiments of a locking mechanism are suitable for use in accordance with the present invention, the present locking mechanism being chosen because it is inexpensive, simple to operate, and reliable, and because it is well suited for insertion in many printing apparatuses.

The embodiments of the invention described above are intended to be exemplary only. The scope of the invention is therefore intended to be limited solely by the scope of the appended claims.

I claim:

1. An apparatus for housing a page-wide array (PWA) of print heads comprising a linear array of print nozzles in a lateral direction, comprising:

a support structure adapted to house the PWA and to be attached to a wall structure at a closed lateral end, an opposite open end for lateral insertion and removal of the PWA, and an opening in a front face between the open and closed ends through which the array of nozzles in the PWA may operate while housed in the structure;

an adjustable protrusion extending within the structure from the closed end whereby the lateral position of the PWA may be fixed relative to the closed end of the structure; and a locking mechanism at the open end whereby, when engaged, the PWA may be secured against the protrusion and prevented from moving in a lateral direction.

2. An apparatus as claimed in claim 1, wherein the protrusion engages the wall structure.

3. An apparatus as claimed in claim 2, wherein the protrusion comprises a longitudinal element in threaded engagement with a bore in the wall structure, whereby the extent of the protrusion into the structure may be adjusted.

4. An apparatus as claimed in claim 3, wherein the protrusion further comprises a releaseable locking element whereby, while locked, the extent of the protrusion can be maintained.

5. An apparatus as claimed in claim 3, wherein the longitudinal element comprises an internal bore adapted to accept a tool to apply rotational force on the longitudinal element.

6. An apparatus as claimed in claim 1, wherein the protrusion engages the PWA at its center of mass.

7. An apparatus as claimed in claim 1, whereby the locking mechanism is biased in an open position and securable in a closed position.

8. An apparatus as claimed in claim 1, wherein the locking mechanism, when engaged, applies lateral pressure on the PWA at its center of mass.

9. An apparatus as claimed in claim 1, wherein the locking mechanism comprises a contact pad adapted to engage the PWA.

10. An apparatus as claimed in claim 9, wherein the upper and lower supporting surfaces permit low friction insertion and removal of the PWA.

11. An apparatus as claimed in claim 9, wherein the upper and lower supporting surfaces are constructed of stainless steel.

12. An apparatus as claimed in claim 1, further comprising upper and lower supporting surfaces for constraining vertical movement of the PWA while housed within the structure.

13. An apparatus as claimed in claim 1, wherein the face opposite the front face has an opening adapted to accept connectors for the PWA.

14. An apparatus as claimed in claim 1, further comprising means for urging the PWA forward against the front face.

15. An apparatus for housing a plurality of page-wide arrays (PWAs) of print heads each comprising a linear array of print nozzles in a lateral direction, comprising:

a plurality of support structures each adapted to house a PWA, the structures being stacked in a fixed vertical array and to be each attached to a wall structure at a closed lateral end, each structure having an opposite open end for lateral insertion and removal of the corresponding PWA, and an opening in a front face between the open and closed ends through which the array of nozzles in the corresponding PWA may operate while housed in the structure;

an adjustable protrusion extending within each structure from the closed end whereby the lateral position of the corresponding PWA may be fixed relative to the closed end of the structure; and a locking mechanism at the open end of the structures whereby, when engaged, the PWA in each structure may be secured against the corresponding protrusion and prevented from moving in a lateral direction, whereby the lateral position of each PWA may be fixed in relation to the lateral position of each other and with respect to the wall structure.

16. A printing system comprising:

a fixed printing area;

feeding means for moving a medium to be printed at a predetermined rate across the printing area;

a plurality of page-wide arrays (PWAs) of print heads, each comprising a linear array of print nozzles in a lateral direction, a plurality of support structures each housing a page-wide array (PWA) of print heads oriented so that their respective linear arrays of print nozzles extend in a direction transverse to the direction of motion of the medium to be printed, the structures being stacked in a fixed vertical array and to be each attached to a wall structure at a closed lateral end, each structure having an opposite open end for lateral insertion and removal of the corresponding PWA, and an opening in a front face between the open and closed ends through which the array of nozzles in the corresponding PWA may operate while housed in the structure, the array of structures being so oriented that the medium to be printed passes between the printing area and the front faces of the structures and parallel thereto;

an adjustable protrusion extending within each structure from the closed end whereby the lateral position of the corresponding PWA may be fixed relative to the closed end of the structure; and a locking mechanism at the open end of the structures whereby, when engaged, the PWA in each structure may be secured against the corresponding protrusion and prevented from moving in a lateral direction, whereby the lateral position of each PWA may be fixed in relation to the lateral position of each other and with respect to the wall structure;

and whereby the printed output on the medium to be printed may aligned in a direction transverse to the direction of motion of the medium to be printed.

* * * * *